United States Patent [19]

Flippin

[11] 4,079,593

[45] Mar. 21, 1978

[54] VIBRATORY CABLE LAYING PLOW

[75] Inventor: James S. Flippin, Clearwater, Kans.

[73] Assignee: J.I. Case Company, Racine, Wis.

[21] Appl. No.: 820,994

[22] Filed: Aug. 1, 1977

[51] Int. Cl.[2] ..... F16L 1/02; E02F 5/02

[52] U.S. Cl. ..... 61/72.6; 37/193; 172/40

[58] Field of Search ..... 61/72.5, 72.6; 37/193, 37/DIG. 18; 172/40, 671

[56] References Cited

U.S. PATENT DOCUMENTS

| | | | |
|---|---|---|---|
| 3,914,948 | 10/1975 | Kaercher | 61/72.6 |
| 3,952,810 | 4/1976 | Ulrich | 172/40 |

FOREIGN PATENT DOCUMENTS

| | | | |
|---|---|---|---|
| 1,189,602 | 3/1965 | Germany | 61/72.6 |

*Primary Examiner*—Paul R. Gilliam
*Assistant Examiner*—David H. Corbin
*Attorney, Agent, or Firm*—Cullen, Settle, Sloman & Cantor

[57] ABSTRACT

The disclosed vibratory cable plot has two in line plow blades supported on a trailer having a transverse horizontal pivot and a vibrator which imparts a rocking oscillatory motion to the trailer and the blades. The first blade is preferably shorter, but thicker than the second trailing blade. The second blade is longer than the first blade and has a trailing cable guide guiding flexible cable, pipe and the like into the slot cut by the blades. The double blade assembly is more efficient than a single blade and reduces blade wear.

10 Claims, 4 Drawing Figures

VIBRATORY CABLE LAYING PLOW

FIELD OF THE INVENTION

The present invention relates to cable laying plows for laying flexible cable, conduit, pipe and the like underground. More particularly, the present invention relates to vibratory cabel laying plows having a vibrator or shaker which imparts vibration to the blade to reduce draw bar pull.

Vibration is applied to plows to reduce the force required to pull the plow through the ground or reduce the "draw bar pull", see U.S. Pat. No. 3,357,498 of Higley. Later, it was discovered that a vibrator or shaker which imparted generally vertical vibrations would also reduce the ground disturbance in a cable laying plow. Double weight vibrators having two eccentric weights timed to rotate 180° out of phase have been used commercially in cable laying plows, see U.S. Pat. No. 3,618,237 of Davis. Generally, the axes of rotation of the eccentric weights are parallel to the longitudinal axis of the vehicle to impart "pure" vertical vibration. The prior art has also suggested turning the double weight vibrator to impart an arcuate motion to the blade as disclosed in U.S. Pat. No. 3,935,712.

Vibration does not however eliminate wear of the blade and even a vibratory cable plow blade must be periodically replaced. Examination of a worn blade indicates that the blade wears first at the bottom of the blade; generally the bottom one-third of the blade is worn first. Further, substantial energy is required to vibrate the blade in a commercial cable laying plow. The double plow assembly of the present invention reduces the "apparent" cutting depth of the second trailing blade and the vibration is more efficient as described hereinbelow.

SUMMARY OF THE INVENTION

The vibratory cable laying plow assembly of the present invention is designed to be towed behind a prime mover, such as a tractor or bulldozer. The assembly is referred to as a cable laying plow assembly, however it will be understood that the plow may be utilized for laying any flexible element such as cable, conduit and flexible pipe. Further, the cable may be pulled through the ground, wherein the cable guide is a means to attach the cable to the trailing bottom edge of the blade. The cable may also be laid in the ground from a cable reel on the prime mover, in which case the cable guide is a tube or channel on the trailing edge of the plow blade.

The vibratory cable laying plow of this invention includes a trailer pivotally supported for oscillatory motion on a horizontal pivot transverse to the longitudinal axis of the prime mover. In one embodiment, the trailer is supported on a trosion bushing having transverse horizontal pivot axes. In another embodiment, the trailer is supported on pneumatic tires at the front and back and the trailer is pulled by a U-shaped yoke, wherein the bit of the yoke is pivotally attached to the prime mover and the trailer is pivotally supported between the arms of the yoke. In both embodiments, a double weight vibrator having two rotatable eccentric weights is mounted on the trailer with the axes of rotation of the weights parallel to the horizontal trailer pivot with one weight spaced on each side of the trailer pivot to impart a rocking oscillatory motion to the trailer about the transverse trailer pivot. In the preferred embodiment, the weights are timed 180° out of phase and the vibrator is centered on the longitudinal trailer pivot such that the trailer rocks about the trailer pivot as one eccentrically mounted weight rotates downwardly and the other weight rotates upwardly.

As described, the vibratory plow assembly includes two in line plow blades, preferrably in the longitudinal axis of the trailer. The first blade is mounted forward of the vibrator. In the embodiment having forward and rearward wheels, the blade is mounted between the forward wheel and the vibrator. The trailing plow blade is a cable laying plow having a cable guide on the trailing edge of the blade to guide a flexible element into the slot made by the plow blades. The rocking motion of the trailer thus imparts rocking arcuate vibration in the blades.

In the preferred embodiment of the invention, the first or leading blade is shorter in length than the second or trailing blade and the first blade is thicker. The thickness being measured transverse to the longitudinal axis of the trailer. The first blade therefore reduces the "apparent" cutting depth of the second blade and the first blade is shorter than the cable laying depth, thus reducing wear in both blades. Further, the rocking oscillatory motion imparted by the vibratory mounted transverse to the longitudinal axis of the trailer reduces the power requirement and thus results in a more efficient system.

Other advantages and meritorious features of the vibratory cable laying plow of this invention will be more fully understood from the following description of the preferred embodiments, the appended Claims and the drawings, a brief description of which follows.

DESCRIPTION OF THE PREFERRED EMBODIMENTS

Figure 2:
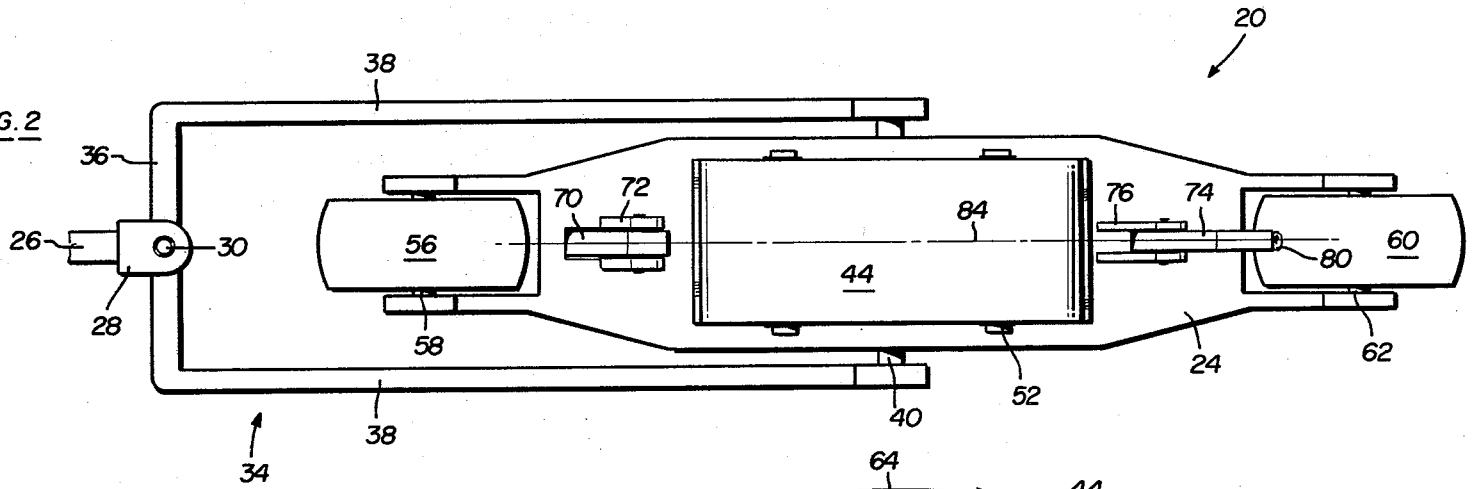
FIG. 2 is a top view of the embodiment of the Vibratory Cable Laying Plow shown in FIG. 1.
Figure 1:
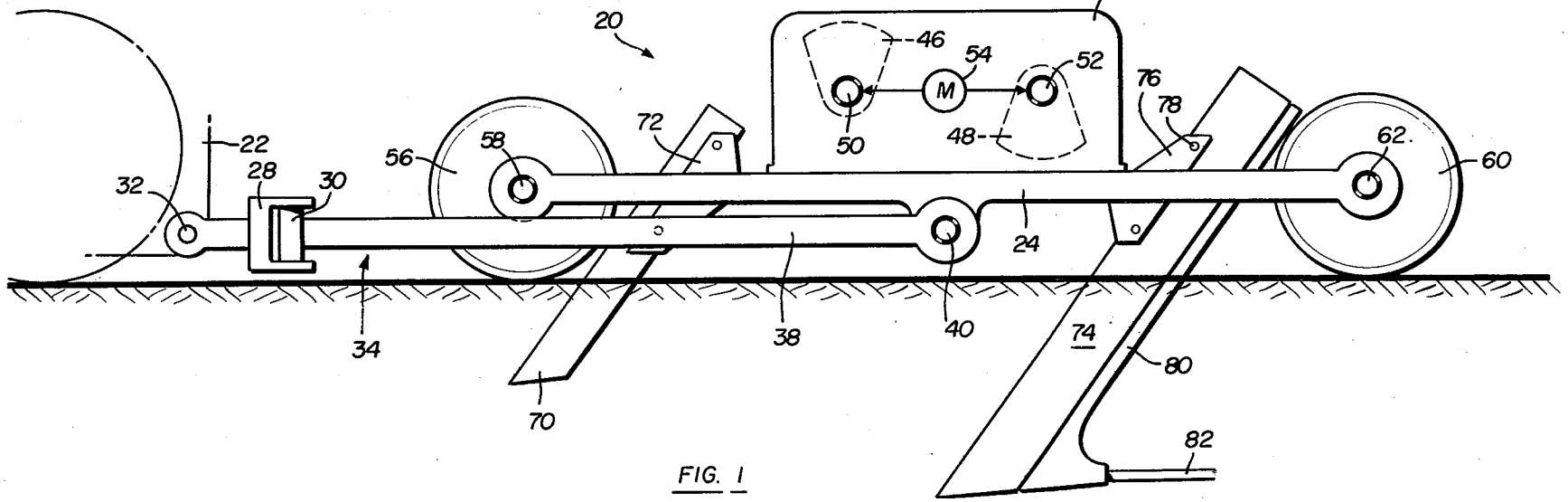
FIG. 1 is a side view of one embodiment of the Vibratory Cable Laying Plow of this invention.

The Vibratory Cable Laying Plow 20 shown in FIGS. 1 and 2 may be towed or pulled behind any conventional prime mover 22, such as a tractor, bulldozer or other vehicle. The plow assembly includes a trailer 24 which is connected to the prime mover by a hitch 26. In the disclosed embodiment, the hitch has a bifurcated portion 28 which pivotally supports the vertical pin 30 of the U-shaped yoke 34. The hitch may also have a horizontal pivot connection 32 to the prime mover permitting universal movement of the plow assembly as it follows the prime mover.

The U-shaped yoke 34 includes a center bite portion 36 which includes the vertical pivot pin 30 and opposed rearwardly extending arms 38 as shown in FIG. 2. The trailer 24 is pivotally supported between the arms by transverse horizontal pivot pin 40. The trailer is thus steered by the prime mover about vertical and horizontal pivot pins 30 and 32, respectively.

A vibrator or shaker 44 is rigidly mounted on the trailer 24. The vibrator includes a pair of weights 46 and 48 eccentrically mounted for rotation on shafts 50 and 52, respectively. The weights are rotatably driven by motor 54. A double weight vibrator of the general type disclosed herein is disclosed in U.S. Pat. No. 1,999,213. The trailer is supported on pneumatic tires 56 and 60. The tires are rotatably supported on axles 58 and 62, respectively.

As shown, the eccentric weights 46 and 48 are rotatably supported on shafts 50 and 52, respectively, such that the axes of rotation are equally spaced from and parallel to the transverse horizontal pivot 40 of the trailer 22. The pneumatic tires 56 and 60 yieldably support the forward and rearward ends, respectively, of the trailer. In the preferred embodiment, the weights are rotatably timed one hundred eighty degrees out of phase, such that the trailer rockingly oscillates about the axis of the transverse horizontal pivot 40 as shown by arrow 64. This rocking oscillatory motion is imparted to the blades of the plow assembly as described below.

The plow assembly of the present invention includes a first generally vertical blade 70 supported on bracket 72 in the trailer 24, generally in the longitudinal axis 84 of the trailer and prime mover. The trailing blade 74 is mounted on a bracket 76 in the trailer 24. As shown, the trailing blade 74 is in line with the first blade 70 as the blades are pulled through the ground and both blades are preferrably in the longitudinal axis 84 of the prime mover. It will be understood that the blades may be pivotally mounted and individually steerable in large cable laying plow assemblies. The second blade is a cable laying plow having a trailing cable guide. In the disclosed embodiment, the guide comprises a tubular guide 80 on the trailing edge of the blade which receives cable, flexible pipe or conduit 82 which is disposed in the slot cut by the plow blade. As described above, the cable guide may be simply a connection at the lower trailing edge of the blade for pulling cable or the like through the slot cut by the plow blade.

In the preferred embodiment the first blade 70 is shorter than the trailing cable laying blade 74. For example, the first blade in one embodiment of the cable plow was 26 inches and the second trailing cable blade was 38 inches, such that the first blade was about two-thirds the length of the second blade. As described above, it has been discovered that the bottom one-third of the blade of a cable laying plow is worn first. Thus, the first blade reduces the "apparent" cutting depth of the second trailing cable laying blade. Further, the first blade 70 is preferrably slightly thicker than the second blade. For example, the first blade in one embodiment has a thickness of one and one quarter inches measured transversely to the longitudinal axis 84. The trailing cable laying blade 74 had a thickness of 1 inch. The first blade 70 thus reduces the wear of the trailing cable laying blade 74, which is particularly important because the trailing cable laying blade is substantially more expensive than the first blade 70.

As described above, the rocking oscillatory motion generated by the vibrator 44 about the transverse horizontal pivot 40 is imparted to the plow blades 70 and 74. As described, the pneumatic tires 56 and 60 yieldably support the trailer, such that the blades are vibrated generally vertically in an arcuate oscillatory digging motion. This motion reduces the power requirements of the cable laying plow and the in line double plow assembly reduces the wear of the blades, particularly the trailing cable laying plow blade 74.

The embodiment of the Vibratory Cable Laying Plow Assembly 90 shown in FIGS. 3 and 4 functions substantially as described above in regard to FIGS. 1 and 2, however the structure has been modified as described below. The plow assembly 90 is adapted to be pulled behind a prime mover 92. In the disclosed embodiment, the prime mover includes a generally vertical mast assembly 94 which may be utilized for towing various implements. The plow assembly includes a pair of opposed L-shaped plates 96 which form the tow mast which is pivotally connected by horizontal pivot 98 to the prime mover mast assembly. The L-shaped plates 96 are welded or otherwise secured to tow frame members 100. The trailer assembly is supported by a pair of wheels 102 which are rotatably supported on axles 104. The axles are secured to the tow frame members 100 as best shown in FIG. 4.

Figure 4:
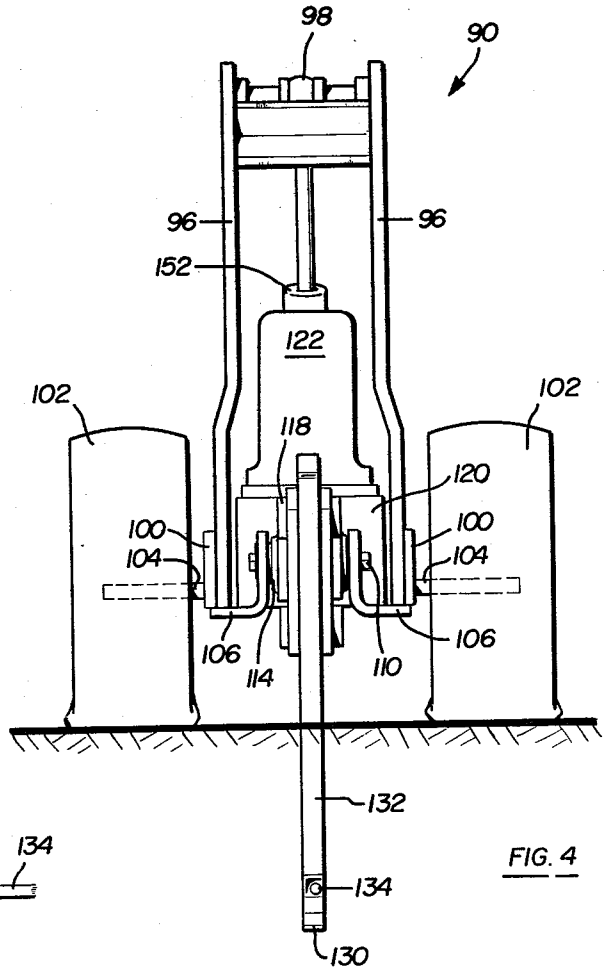
FIG. 4 is an end view of the Vibratory Cable Laying Plow disclosed in FIG. 3.

Each of the tow frame members 100 are welded or otherwise secured to L-shaped plates 106 as shown in FIG. 4. The free ends of the plates 106 extend upwardly and a torsion bearing 112 is bolted by bolts 110 between the plates as shown in FIG. 4. The torsion bearing 112 comprises an inner cylindrical tube-shaped member 114 which is slightly spaced from the opposed faces of plates 106. A generally rectangular tube 16 surrounds the inner tube 114 and a resilient torsion bearing material is molded or assembled between the inner and outer members 114 and 116, respectively. For example, the inner and outer tubular members may be formed of steel and the torsion material may be synthetic rubber molded between the members 114 and 116.

The vibrator trailer assembly is supported on the outer torsion bearing member 116. In the disclosed embodiment, plates 118 are secured as by welding to the outer bearing member 116. A box-shaped vibrator trailer frame 120 is supportingly secured on the plates 118 and the vibrator 122 is rigidly secured to the trailer frame 120. A bracket 124 is secured by welding or other means to the rearward end of the trailer frame 120 and the trailing cable laying blade 130 is secured by pins 126 or the like to the bracket 124. As described above, the cable laying blade includes a cable guide 132 for laying cable, flexible conduit or pipe 134 in the cut made by the blades. A bracket 136 is secured to the forward end of the vibrator trailer frame 120 and the first or leading blade 138 is secured in the bracket 136.

Figure 3:
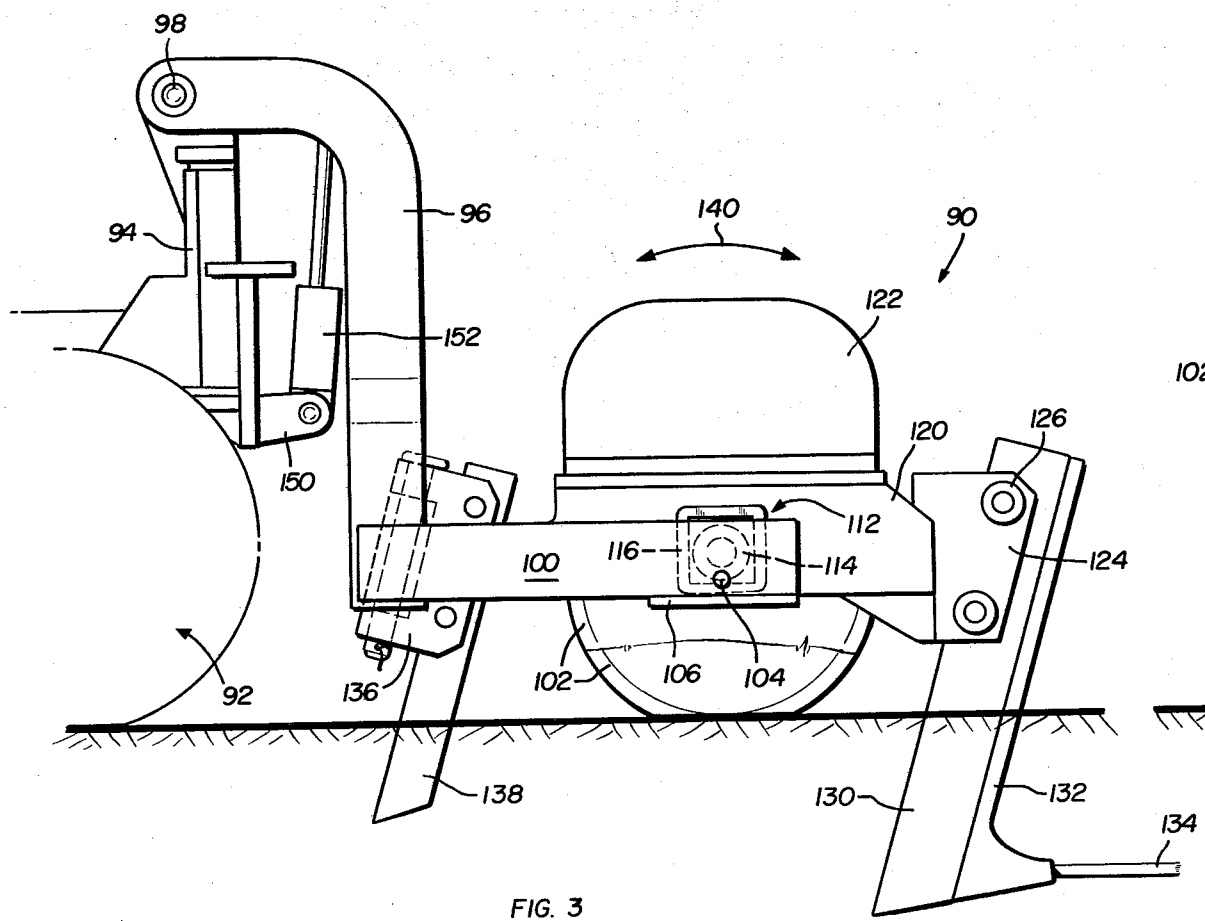
FIG. 3 is a side view of a second embodiment of the Vibratory Cable Laying Plow of this invention.

The operation of the vibratory plow assembly 90 disclosed in FIGS. 3 and 4 is therefore as follows. The vibrator 122 includes a pair of oppositely rotating eccentric weights not shown, but as described above. The weights are generally equally spaced on opposed sides of the transverse horizontal pivot axis, which in the disclosed embodiment is the torsion bearing 112. The vibrator-trailer frame 120 is thus rockingly oscillated about the transverse pivot axis of the torsion bushing as shown by arrow 140. The blades 130 and 138 are similarly vibrated in a rocking motion substantially independent of the tow frame members 96 and 100, and the tires 102. As described above, the leading or first blade 138 is preferrably shorter than the trailing cable laying blade 130 and the first blade 138 is preferrably slightly thicker than the trailing blade.

Various details of the Vibratory Cable Laying Plow shown in FIGS. 3 and 4 have not been described because such details will be understood by those skilled in the art from the prior art and the description above. For example, the blades 130 and 138 must track if the double blade assembly is to be effective. In the preferred embodiment, the trailer may be supported on a vertical pivot. For example, the bracket 136 of the first plow may be pivotally connected by a vertical pivot pin to the tow frame 100. The mast 94 may also be pivotally supported on the prime mover. The entire plow assembly may also be raised and lowered about the transverse horizontal pivot 98 of the mast assembly. For example, a hydraulic piston-cylinder 152 may be interconnected between the ear 150 of the mast assembly and the tow mast 96. Extension of the piston-cylinder will raise the entire cable plow assembly 90 to lift the plow blades out of the ground or the piston-cylinder may be retracted to lower the plow blades into the ground.

The Vibratory Cable Laying Plow disclosed in FIGS. 3 and 4 has therefore all of the advantages of the cable plow described above in regard to FIGS. 1 and 2. The cable plow of FIGS. 3 and 4 reduces wear of the blades, particularly the cable laying blade 130. The rocking oscillatory motion of the double blade assembly also requires less energy than the prior art. The vibratory plow assembly disclosed in FIGS. 3 and 4 further isolates the vibration from the prime mover by supporting the vibrator trailer frame assembly on a torsion bushing, permitting the rocking oscillatory motion described above while isolating the vibration from the prime mover 92.

Having described the preferred embodiments of the Vibratory Cable Laying Plow Assembly of this invention, it is understood that various modifications may be made without departing from the invention described herein which is limited only by the claims which follow.

I claim:

1. A vibratory cable laying plow assembly to be towed behind a prime mover, comprising:

a trailer pivotally supported for oscillatory motion on a horizontal trailer pivot, said trailer pivot transverse to the longitudinal axis of the prime mover, a double weight vibrator having two rotatable eccentric weights mounted on said trailer with the axes of rotation of said weights parallel to said horizontal trailer pivot with one weight spaced on each side of said trailer pivot to impart a rocking oscillatory motion to said trailer about said trailer pivot, a first plow blade mounted on said trailer forward of said trailer pivot and said first plow blade extending downwardly to cut a slot in the ground, and a cable laying plow blade mounted on said trailer, rearwardly of said trailer pivot in generally the longitudinal path of said first blade, said cable laying plow blade extending downwardly and having a cable guide on the trailing edge of the plow blade to guide a flexible element into the slot cut by the plow blades.

2. The vibratory cable laying plow assembly defined in claim 1, characterized in that said cable laying plow blade is longer than said first plow blade.

3. The vibratory cable laying plow assembly defined in claim 2, characterized in that said first plow blade is thicker than said cable laying plow blade.

4. The vibratory cable laying plow assembly defined in claim 2, characterized in that said cable laying plow blade is about one-third longer than said first plow blade.

5. The vibratory cable laying plow assembly defined in claim 1, characterized in that said trailer and vibrator are supported on a torsion bushing having a transverse pivot axis, such that said trailer rockingly oscillates about said torsion bushing.

6. The vibratory cable laying plow assembly defined in claim 1, characterized in that said trailer is supported on two longitudinally spaced wheels, each wheel having an axle transverse to the longitudinal axis of said prime mover, one wheel located at the forward end of said trailer and the other wheel located at the rearward end.

7. The vibratory cable laying plow assembly defined in claim 6, characterized in that said trailer is pulled by a U-shaped yoke having a central bite portion and a pair of rearwardly extending arms, said bite portion being pivotally attached to the prime mover and said trailer pivotally supported on opposed sides to said arms, said pivotal support defining said trailer pivot

8. A vibratory cable laying plow assembly to be towed behind a prime mover, comprising:

a trailer supported for rocking oscillatory motion on a horizontal pivot, said trailer pivot transverse to the longitudinal axis of the prime mover, a double weight vibrator having two rotatably supported eccentric weights timed to rotate 180 degrees out of phase, a power means rotating said weights, said vibrator mounted on said trailer with the axes of rotation of said weight parallel to said horizontal trailer pivot with said weight equally spaced on opposed sides of said trailer pivot to impart a rocking oscillatory motion to said trailer about said trailer pivot, a first plow blade mounted on said trailer forward of said vibrator generally in the longitudinal axis of said trailer, said first plow blade extending downwardly to cut a slot in the ground, and a cable laying plow blade mounted on said trailer rearward of said vibrator generally in the longitudinal axis of said trailer and spaced from said trailer pivot a distance generally equal to the distance between said first plow blade and said trailer pivot, said cable laying plow blade extending downwardly a distance greater than said first plow blade and said cable laying plow blade having a cable guide on the trailing edge of the blade to guide a flexible element into the slot cut by said plow blades.

9. The vibratory cable laying plow assembly defined in claim 8, characterized in that said trailer is supported on a torsion bushing having a transverse pivot axis.

10. The vibratory cable laying plow assembly defined in claim 8, characterized in that said first plow blade is thicker than said cable laying plow, the thickness being measured transverse to the longitudinal axis of said prime mover.

* * * * *